US009586065B2

(12) United States Patent
Losos et al.

(10) Patent No.: US 9,586,065 B2
(45) Date of Patent: Mar. 7, 2017

(54) MODULAR TANK CRADLE AND BACKPACK FOR SELF-CONTAINED BREATHING APPARATUS

(71) Applicant: Mine Safety Appliances Company, Cranberry, PA (US)

(72) Inventors: David J. Losos, Evans City, PA (US); Bryan J. Peoples, Baden, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 19 days.

(21) Appl. No.: 14/141,582

(22) Filed: Dec. 27, 2013

(65) Prior Publication Data

US 2015/0144674 A1 May 28, 2015

Related U.S. Application Data

(60) Provisional application No. 61/909,512, filed on Nov. 27, 2013.

(51) Int. Cl.

| | |
|---|---|
| ***A62B 9/04*** | (2006.01) |
| ***A45F 3/04*** | (2006.01) |
| ***A62B 25/00*** | (2006.01) |

(52) U.S. Cl.

CPC ..... *A62B 9/04* (2013.01); *A45F 3/04* (2013.01); *A62B 25/00* (2013.01)

(58) Field of Classification Search

CPC ..... A62B 9/04; A62B 25/00

USPC ... 224/628, 633, 261, 907, 934; 128/205.22; 405/186; 24/595.1, 706.4, 707.7; 403/324, 378, 379.5

See application file for complete search history.

(56) References Cited

U.S. PATENT DOCUMENTS

| | | | | |
|---|---|---|---|---|
| 3,033,431 | A * | 5/1962 | Henderson et al. | 224/604 |
| 3,774,825 | A * | 11/1973 | Schone et al. | 224/265 |
| 3,842,611 | A * | 10/1974 | Anderson | 405/186 |
| D342,666 | S * | 12/1993 | DePack | D8/373 |
| 5,390,886 | A * | 2/1995 | Lawner et al. | 248/224.7 |
| 5,781,118 | A | 7/1998 | Wise et al. | |
| 5,887,836 | A * | 3/1999 | Back | 248/221.11 |
| 5,901,890 | A * | 5/1999 | Stokes | 224/406 |
| 5,913,467 | A * | 6/1999 | Berg | 224/628 |
| 8,356,692 | B1 | 1/2013 | Steck et al. | |
| 2004/0082238 | A1* | 4/2004 | Jacoway et al. | 441/136 |
| 2005/0098597 | A1* | 5/2005 | Cottrell et al. | 224/620 |
| 2006/0175492 | A1* | 8/2006 | Cooper | 248/229.17 |

(Continued)

FOREIGN PATENT DOCUMENTS

| | | |
|---|---|---|
| DE | 3342202 A1 | 7/1984 |
| DE | 19541286 A1 | 5/1997 |
| EP | 1952719 A1 | 8/2008 |

OTHER PUBLICATIONS

"PSS 7000 Parts Breakdown", www.draeger.com, 2011, 1 page, Draeger Safety, Inc.

*Primary Examiner* — Justin Larson
*Assistant Examiner* — Scott McNurlen
(74) *Attorney, Agent, or Firm* — The Webb Law Firm

(57) ABSTRACT

An SCBA backpack for air cylinders includes a chassis with a cradle receiving arrangement and a tank cradle for holding at least one air cylinder, wherein the tank cradle is removably secured to the chassis. Such an arrangement permits a variety of different tank cradles that may secure one or more cylinders but that are still compatible with a common backpack chassis.

9 Claims, 9 Drawing Sheets

(56) References Cited

U.S. PATENT DOCUMENTS

2008/0173307 A1* 7/2008 Carron et al. ..... 128/205.22
2008/0257928 A1 10/2008 Lowry et al.

* cited by examiner

MODULAR TANK CRADLE AND BACKPACK FOR SELF-CONTAINED BREATHING APPARATUS

CROSS REFERENCE TO RELATED APPLICATIONS

This application claims benefit of priority from U.S. Provisional Patent Application No. 61/909,512, filed Nov. 27, 2013, which is incorporated herein by reference in its entirety.

BACKGROUND OF THE INVENTION

Field of the Invention

The invention relates to self-contained breathing apparatus and, more particularly, to a coupling between the tank cradle and backpack for a self-contained breathing apparatus.

Description of Related Art

FIG. 1 illustrates an existing self-contained breathing apparatus (SCBA) 10 made up of a backpack 15 having a chassis 20 with an air cylinder 25 mounted thereto by way of a cradle 30. Straps 35 secure the backpack 15 to a user, while hoses 40 are connected to a face mask which provides air to a user. However, in different circumstances, it is desired to use a twin pack comprised of two air cylinders or a plurality of air cylinders, rather than a single cylinder. Currently, this requires the use of separate chassis and cradles and, therefore, each different configuration requires the use of an entirely different backpack. When multiple air cylinder configurations are needed, providing separate backpacks for each configuration may be inefficient.

Therefore, there is a need to provide a single backpack that can accommodate a number of different air cylinder configurations. There is a further need to provide such an arrangement in a configuration that is simple and easy to use.

SUMMARY OF THE INVENTION

Generally, provided is a backpack for holding different air cylinder configurations that improves upon and provides additional features with respect to known backpacks. Preferably, provided is a backpack chassis adapted to receive a variety of removable cradles. Preferably, provided is a cradle that can accommodate a single tank configuration and a cradle that can accommodate a different tank configuration. Preferably, provided is an arrangement utilizing a simple mechanism to engage and disengage a removable cradle to and from the backpack chassis.

In one preferred and non-limiting embodiment, provided is a self-contained breathing apparatus (SCBA) backpack for holding air cylinders or tanks, wherein the backpack has a chassis with a cradle receiving arrangement having a longitudinal axis. A tank cradle for holding at least one air cylinder has an attaching arrangement configured to directly or indirectly interact with the cradle receiving arrangement of the chassis to thereby removably secure the tank cradle to the chassis.

In another preferred and non-limiting embodiment, provided is a chassis for a backpack for holding one or more air cylinders of an SCBA, wherein the one or more cylinders are adapted to be secured to the chassis though a removable tank cradle having a bore extending therethrough. The chassis includes a body having a cradle receiving arrangement defined by at least one wall within the body. At least one bore extends through the at least one wall and is adapted to receive or interact with at least one attaching member configured to secure the tank cradle to the body of the chassis.

In a further preferred and non-limiting embodiment, provided is a tank cradle adapted for holding one or more air cylinders and secured to a cradle receiving arrangement in a chassis of a backpack of an SCBA. The cradle has a base with an attaching arrangement, e.g., one or more projections extending from the chassis body. At least one bore extends through at least a portion of the attaching arrangement and is adapted to receive at least one attaching member configured to extend at least partially through or interact with a common bore in the cradle receiving arrangement.

In a still further preferred and non-limiting embodiment, provided are two tank cradles. One tank cradle is adapted for holding a single air cylinder and the other tank cradle is adapted for holding at least two air cylinders. Each cradle is also adapted to be secured to a common cradle receiving arrangement in a chassis of a backpack of an SCBA. Each of the two cradles includes a base having an attaching arrangement, e.g., one or more projections extending from the body, and at least one bore extending through at least a portion of the attaching arrangement and adapted to receive or interact with at least one attaching member configured to at least partially extend through or interact with a common bore in the cradle receiving arrangement.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
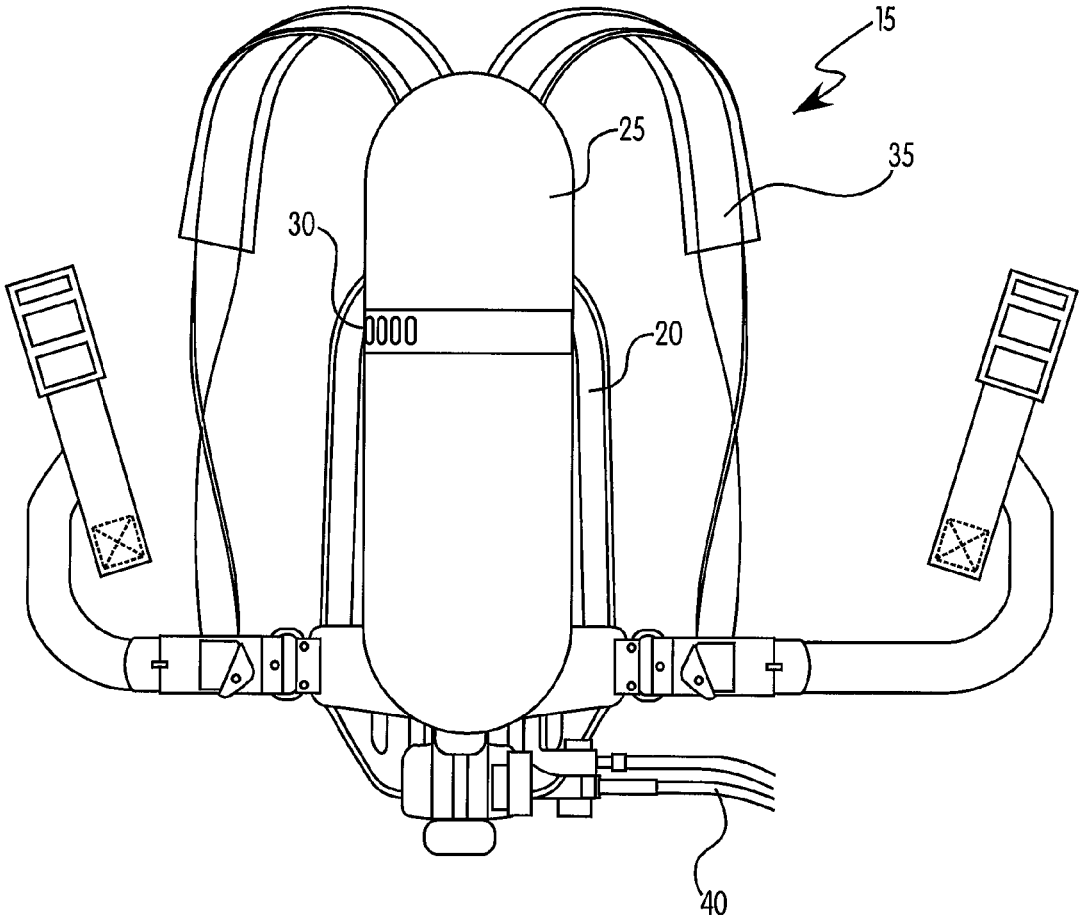
FIG. 1 (Prior Art)
FIG. 1 is a back view of an SCBA with a single cylinder according to the prior art.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Figure 2:
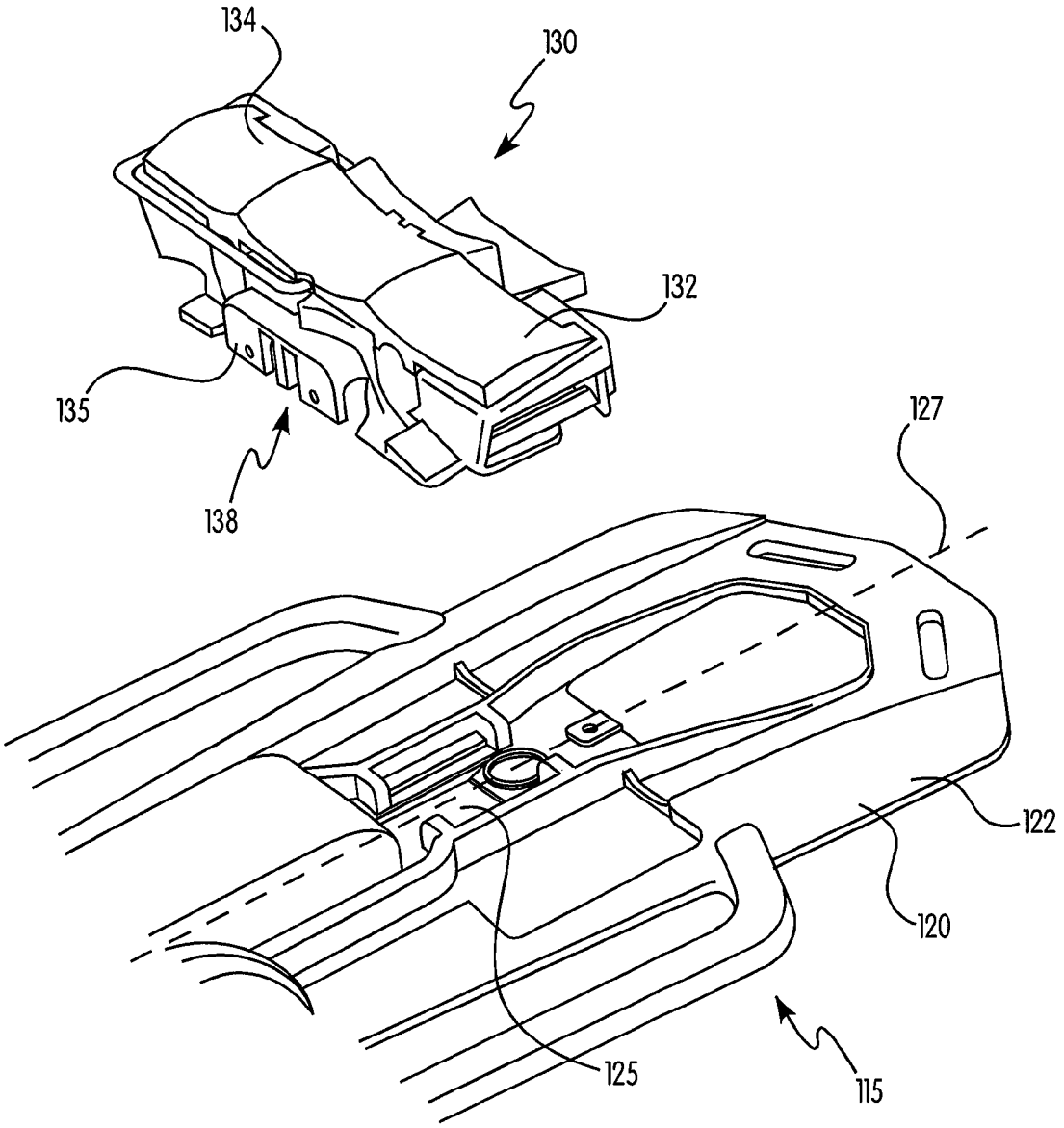
FIG. 2 is an exploded perspective view of a chassis and removable cradle suitable to accommodate two cylinders in accordance with the subject invention.

According to one preferred and non-limiting embodiment, and as illustrated in FIG. 2, provided is a chassis arrangement 115, which is part of a backpack (not shown), such as an existing backpack illustrated in FIG. 1, which would include an air cylinder, hoses, and straps required for use as an SCBA. The chassis arrangement 115 includes a chassis 120 with a cradle receiving arrangement 125, wherein the cradle receiving arrangement 125 has a longitudinal axis 127. The cradle receiving arrangement 125 includes projections, recesses, surfaces, and/or other portions that provide a specified configuration or shape, as illustrated in one preferred and non-limiting embodiment in FIG. 2. A tank cradle 130 is used for holding two air cylinders (not shown), one mounted in arched pad 132 and the other mounted in arched pad 134. Although not illustrated, each of these cylinders is secured to the cradle 130 in an arrangement known to those skilled in the art by using, for example, a strap across the cradle 130.

Figure 3:
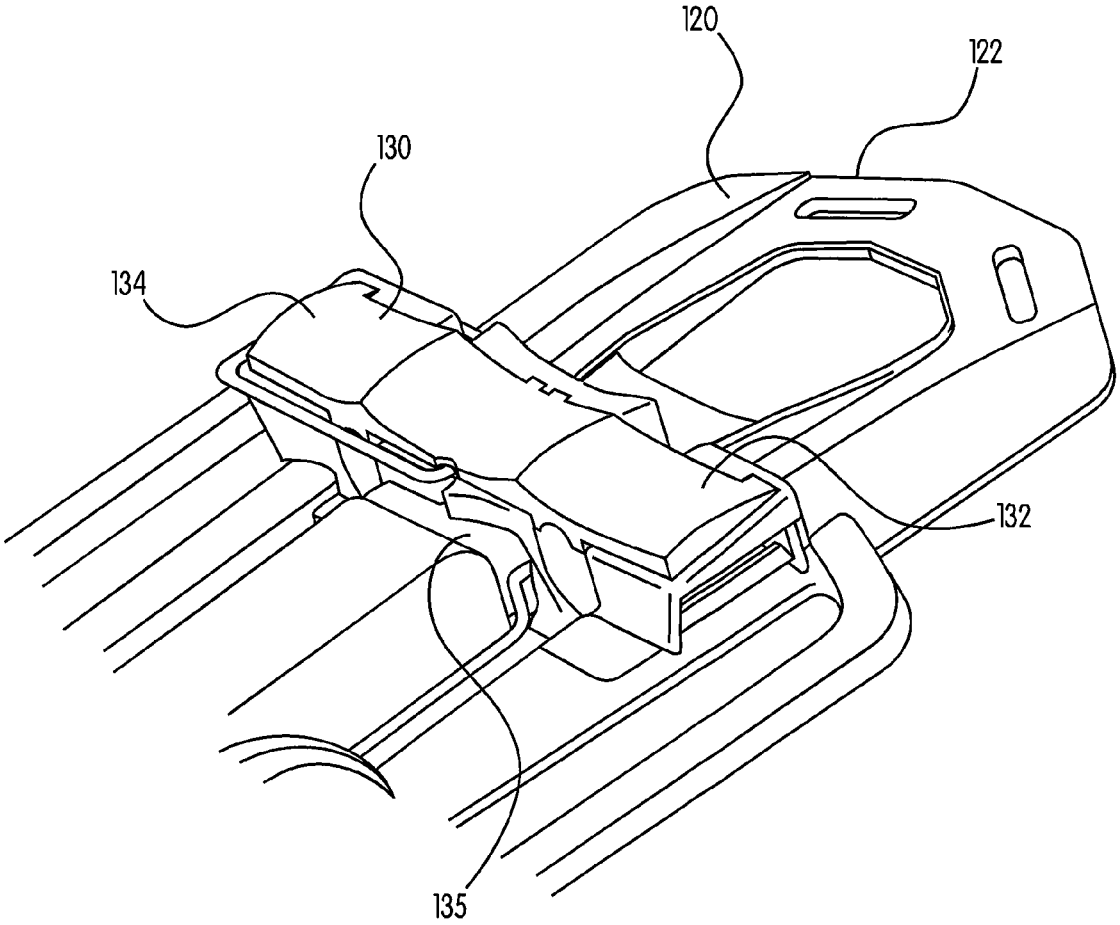
FIG. 3 is an assembled view of the arrangement illustrated in FIG. 2.

The tank cradle 130 has an attaching arrangement 138 configured to directly or indirectly interact with the cradle receiving arrangement 125 of the chassis arrangement 115 to thereby removably secure the cradle 130 to the chassis arrangement 115. As illustrated in FIG. 2, the cradle attaching arrangement 138 may be integrated with or formed on a base 135 of the cradle 130, which is removably secured to the chassis 120. As illustrated in FIG. 3, when the cradle 130 is secured to the chassis 120, the cradle base 135 abuts with a chassis body 122 and is non-rotatably restrained thereto.

Figure 4:
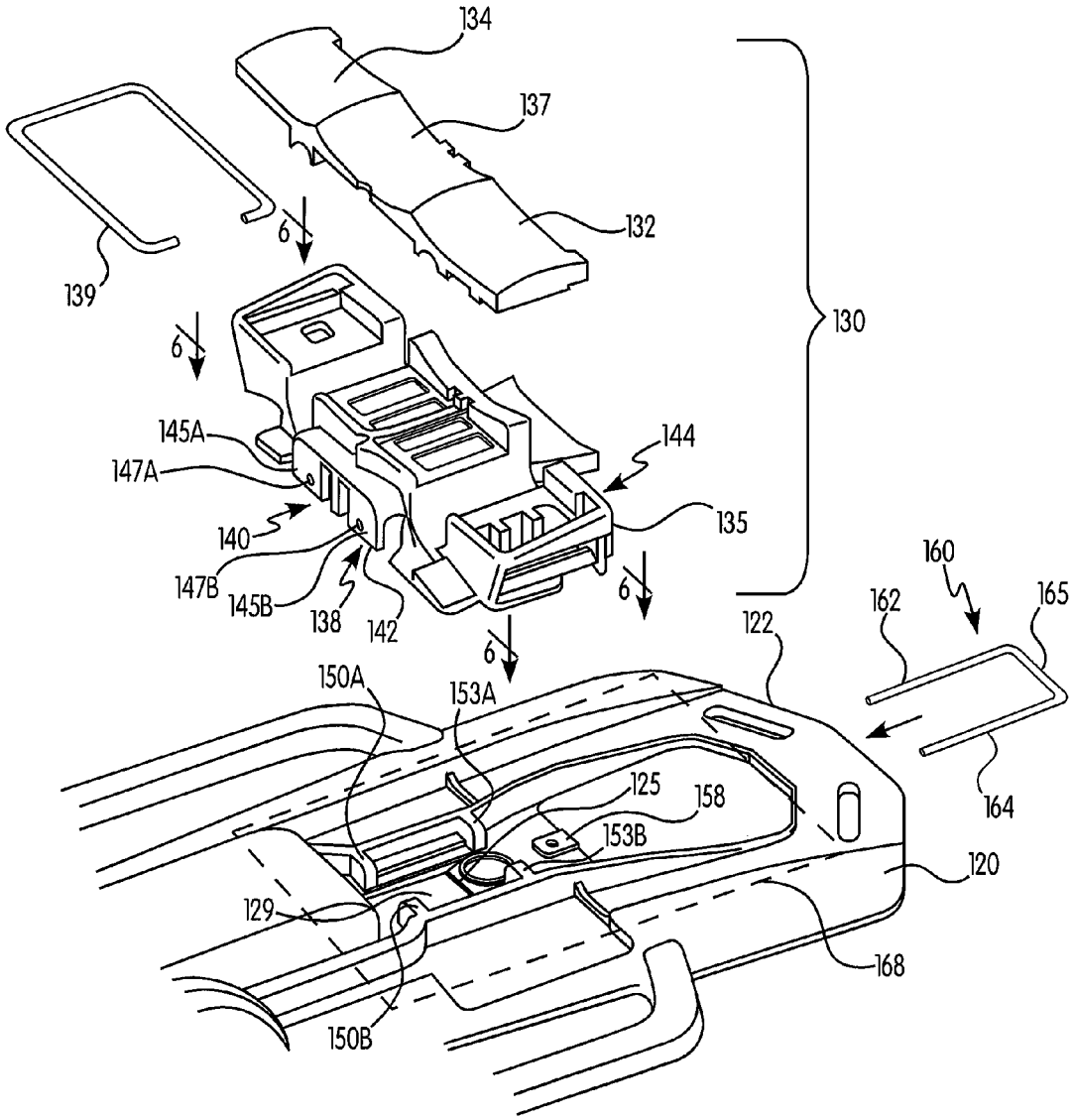
FIG. 4 is a further exploded view of the arrangement illustrated in FIG. 2.
Figure 5:
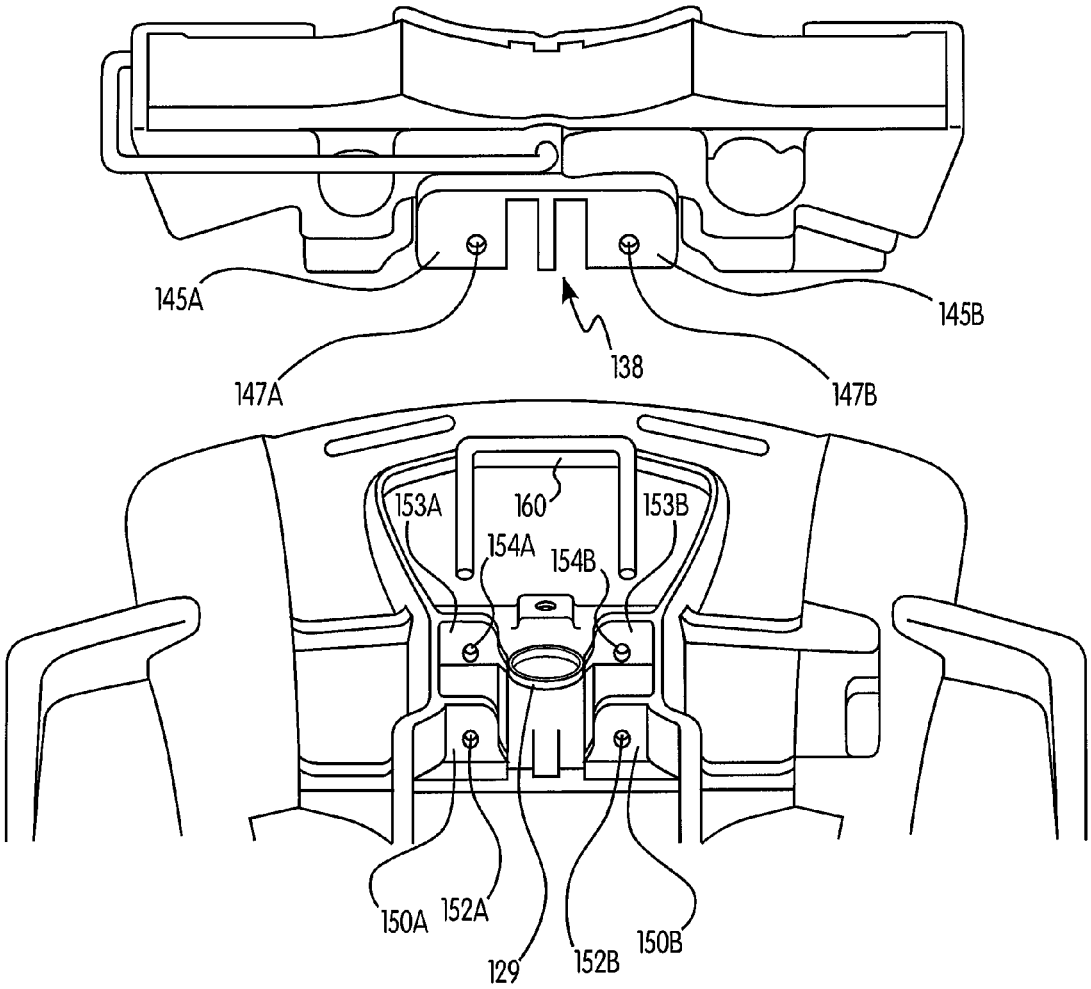
FIG. 5 is an exploded view of FIG. 2 but in a different perspective.
Figure 6:
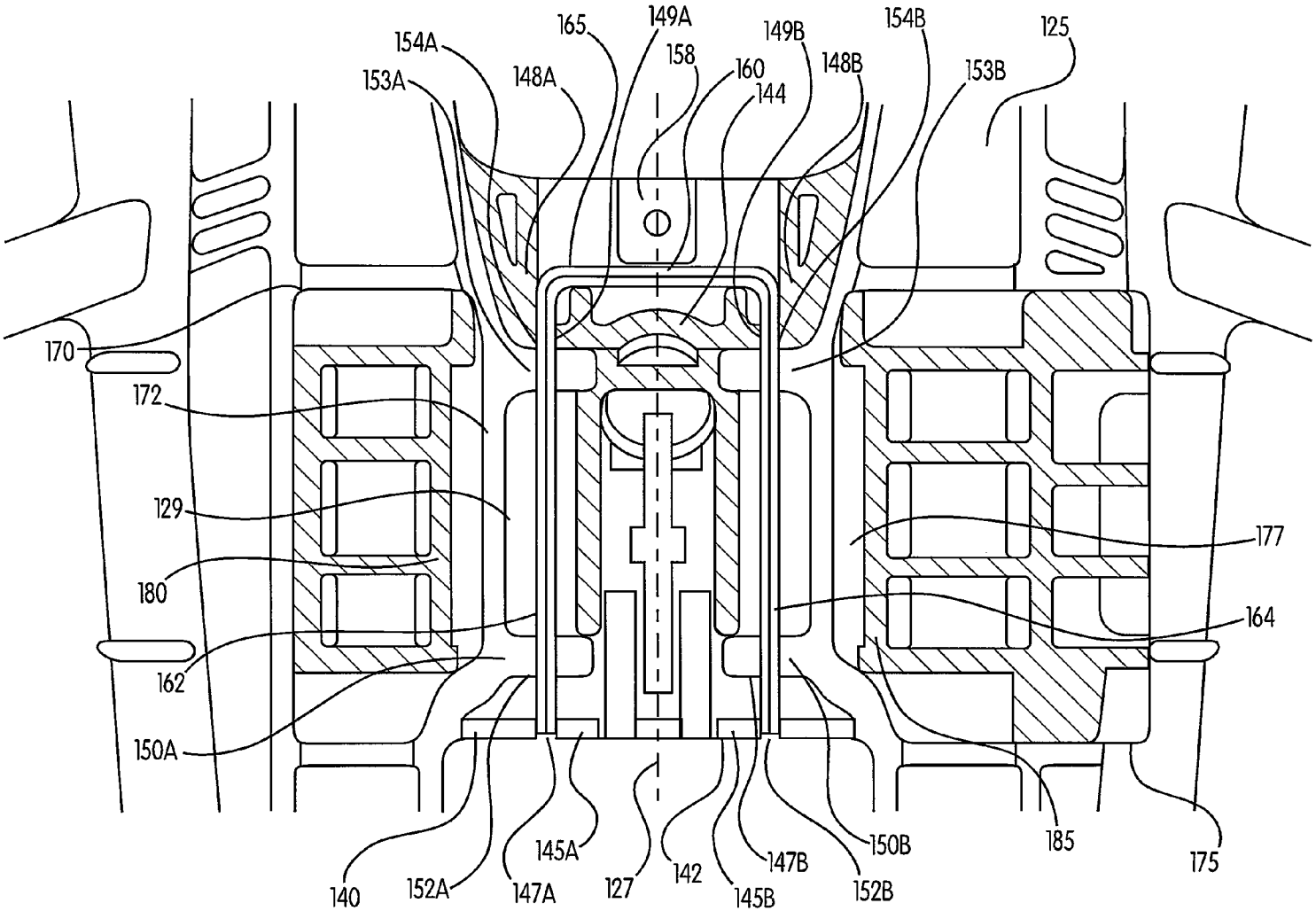
FIG. 6 is a cross sectional plan view showing the footprint of the cradle base mating with the backpack chassis for the arrangement illustrated in FIGS. 2-5.

FIG. 4 provides an additional exploded perspective view similar to that illustrated in FIG. 2, but with the cradle base 135 removed from the remainder of the tank cradle 130. In particular, the cradle 130 includes the cradle base 135, tank pad 137, and a tank restraining bar 139, which, when secured to the cradle base 135, may be engaged by straps (not shown) to secure the tanks to the tank cradle 130. Of particular interest in the subject design is the manner by which the cradle base 135 of the tank cradle 130 engages the cradle receiving arrangement 125 of the chassis 120. With reference to FIGS. 4-6, the cradle receiving arrangement 125 has walls 150A, 150B, each having a bore 152A, 152B extending therethrough. The walls 150A, 150B define a cavity 129.

FIG. 6 is a cross sectional cutaway of the tank cradle along arrows "6" in FIG. 4 with that cross section illustrated by hash marks and superimposed upon the cradle receiving arrangement 125 of the chassis 120. In this preferred and non-limiting embodiment, the attaching arrangement 138 includes a first set of projections 145A, 145B at one end of the cradle base 135, each having a bore 147A, 147B extending therethrough, and a second set of projections 148A, 148B at the second end 144 of the cradle base 135, wherein each projection has a bore 149A, 149B extending therethrough.

For brevity, henceforth, for the reference numbers in which there are two parts, for example 145A,145B, unless stated specifically otherwise, reference will be made to the single reference number with a "'", such as 145' with the understanding that the reference number applies to both parts 145A,145B.

As shown in FIGS. 4-6, the chassis body 122 includes walls 153' with associated bores 154' extending therethrough. As a result, the cradle base 135 has projections 145', 148' and the chassis body 122 has walls 150', 153'. The projections 145', 148' are shaped to engage the walls 150', 153' to locate and non-rotatably secure the cradle base 135 to the chassis body 122. When the cradle base 135 (and, in particular, the attaching arrangement 138 of the cradle base 135) is mounted on, to, or within the cradle receiving arrangement 125, the bores of the respective projections and of the respective walls are substantially aligned with one another, such that an attaching member (which, in one preferred and non-limiting embodiment, is a pin 160 having a first shank 162 and a second shank 164 with a connector 165 therebetween) may be inserted within the bores to secure the cradle base 135 to the chassis body 122, as shown in FIG. 6. As seen in FIG. 5, the projections 145' have corners that are rounded to provide curved ends. This characteristic may exist with each projection 145' and wall to accommodate mating between the cradle base 135 and the chassis body 122. While, in one preferred and non-limiting embodiment, the attaching member is a pin 160, it may also be in the form of or include a "U"-shaped member, a bayonet, a key, an attachment mechanism, an attachment arrangement, or any other member configured or adapted to mate with, engage, and/or interact with the attaching arrangement 138 and/or the cradle receiving arrangement 125.

FIG. 4 illustrates a plane 168 drawn in phantom along the chassis body 122. The walls 150', 153' may extend in a direction substantially perpendicular to the plane 168. Additionally, the projections 145', 148' extending from the cradle base 135 may also extend substantially perpendicular to the plane 168 when the cradle base 135 is mounted to the chassis body 122.

As seen in FIG. 6, projections 145', 148' and the walls 150', 153' may be spaced from one another about the longitudinal axis 127. Additionally the bores 147', 149', 152', 154' extending through the projections 145', 148' and walls 150', 153' may be substantially parallel to the longitudinal axis 127. Although not illustrated, it is also possible for the bores 147', 149', 152', 154' to be non-perpendicular to the longitudinal axis 127. Still further, any suitable configuration of projections, walls, bores, and the like may be used to provide removably attachable functioning between the attaching arrangement 138 and the cradle receiving arrangement 125, e.g., mutually symmetrical arrangements, abutting surfaces, receiving recesses, and the like.

With reference to FIGS. 4 and 6, and in another preferred and non-limiting embodiment, at least one projection 158 can be attached to or formed on or near the cradle receiving arrangement 125. In operation, the attaching member, e.g., the pin 160, is slid through the common bores of the attaching arrangement 138 and the cradle receiving arrangement 125 and over the projection 158. After passing the projection 158, the pin 160 locks or is urged behind the projection 158, thereby removably locking the pin 160 in place. In this manner, the pin 160 would not become easily dislodged or separated and the engagement between the attaching arrangement 138 and cradle receiving arrangement 125 disturbed. This projection 158, or projections 158, may be sized, shaped, slanted, positioned, and/or oriented to facilitate the easy attachment and removal of the attaching member, but prevent accidental dislodging or detachment.

As discussed, the tank cradle 130 is mountable to or within the cradle receiving arrangement 125 of a chassis 120, and the tank cradle 130 is adapted to secure two air cylinders thereto. A benefit of the subject invention is that the same chassis 120 may be used to accommodate a variety of different tank cradles 130, wherein each cradle is capable of having secured thereto a different number (e.g., one, two, three, etc.) of tanks or a different configuration for tanks. As a result, by way of the subject invention, it is no longer necessary to fabricate separate customized backpacks to accommodate a single cylinder, a twin pack, or multiple cylinders. It is only necessary to utilize the common chassis 120 and to attach a tank cradle 130 utilizing the common coupling described herein, such that a single chassis 120 is capable of carrying a variety of different tank configurations.

Figure 7:
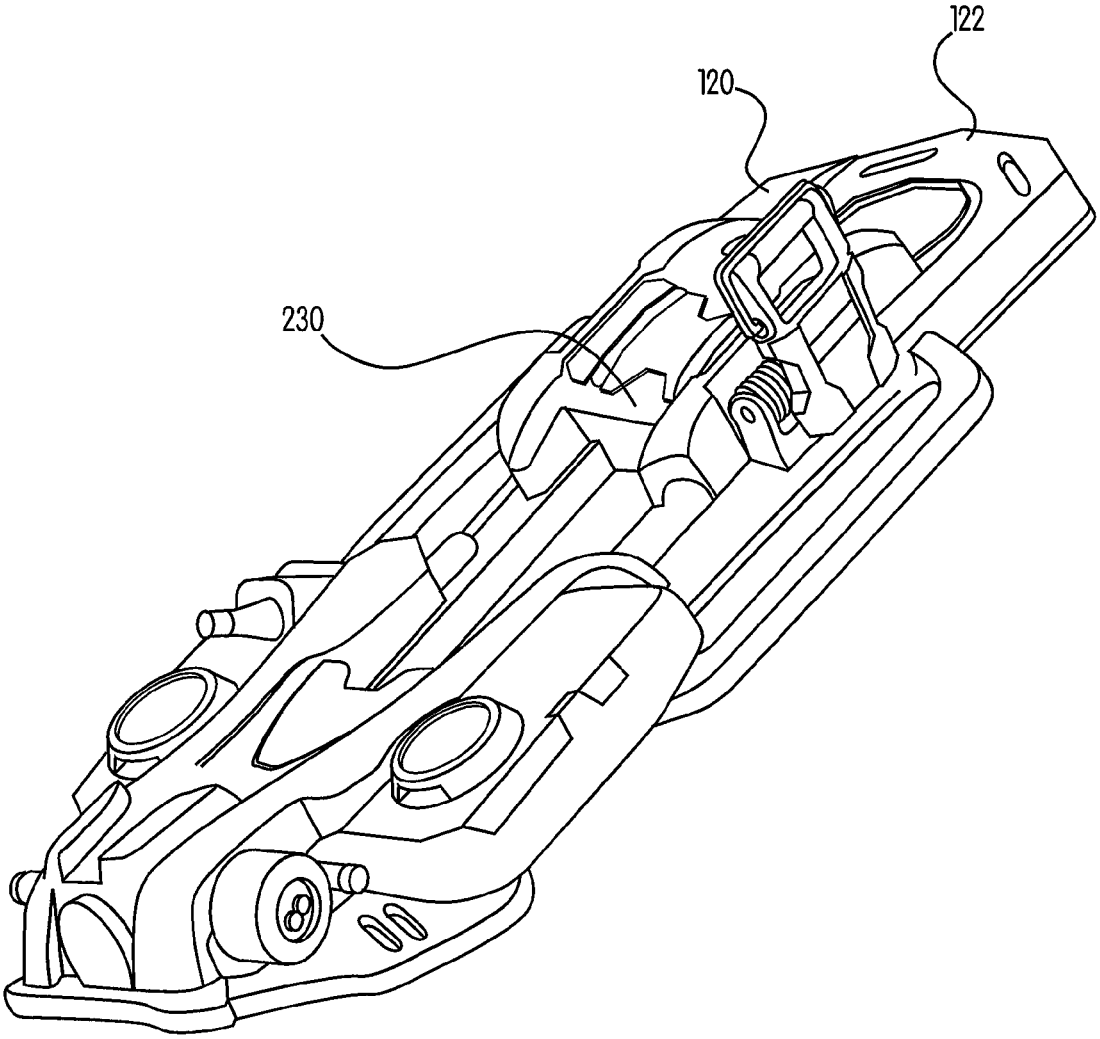
FIG. 7 is a perspective view of an arrangement with a cradle suitable to accept a single cylinder.
Figure 8:
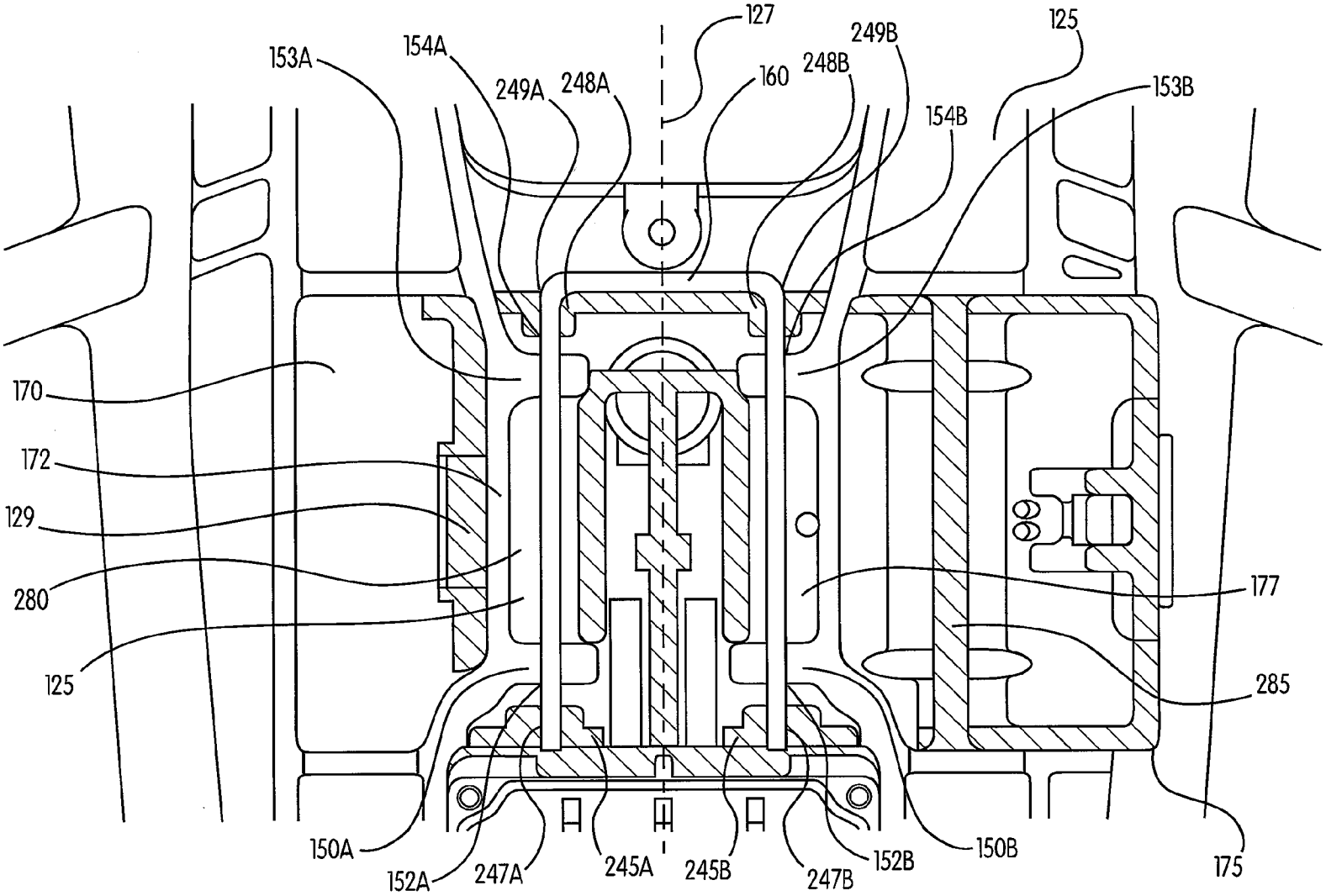
FIG. 8 is a cross section plan view similar to that of FIG. 6, however, showing the foot print for the arrangement illustrated in FIG. 7.

With reference to FIG. 3, what has so far been described is a tank cradle 130 capable of supporting two tanks or cylinders in the arched pad 132 and arched pad 134. By using a different tank cradle having a similar cradle base 130 (i.e., the attaching arrangement 138) that is engageable with the cradle receiving arrangement 125, a different configuration is possible. With reference to FIG. 7, a tank cradle 230 may be mounted to the same chassis 120 as previously described. FIG. 8 is a view similar to that of FIG. 6, but with tank cradle 230, while FIG. 9 is an exploded view of the variety of parts that may be utilized to assemble the tank cradle 230 illustrated in FIG. 7, including the cradle base 235.

Figure 9:
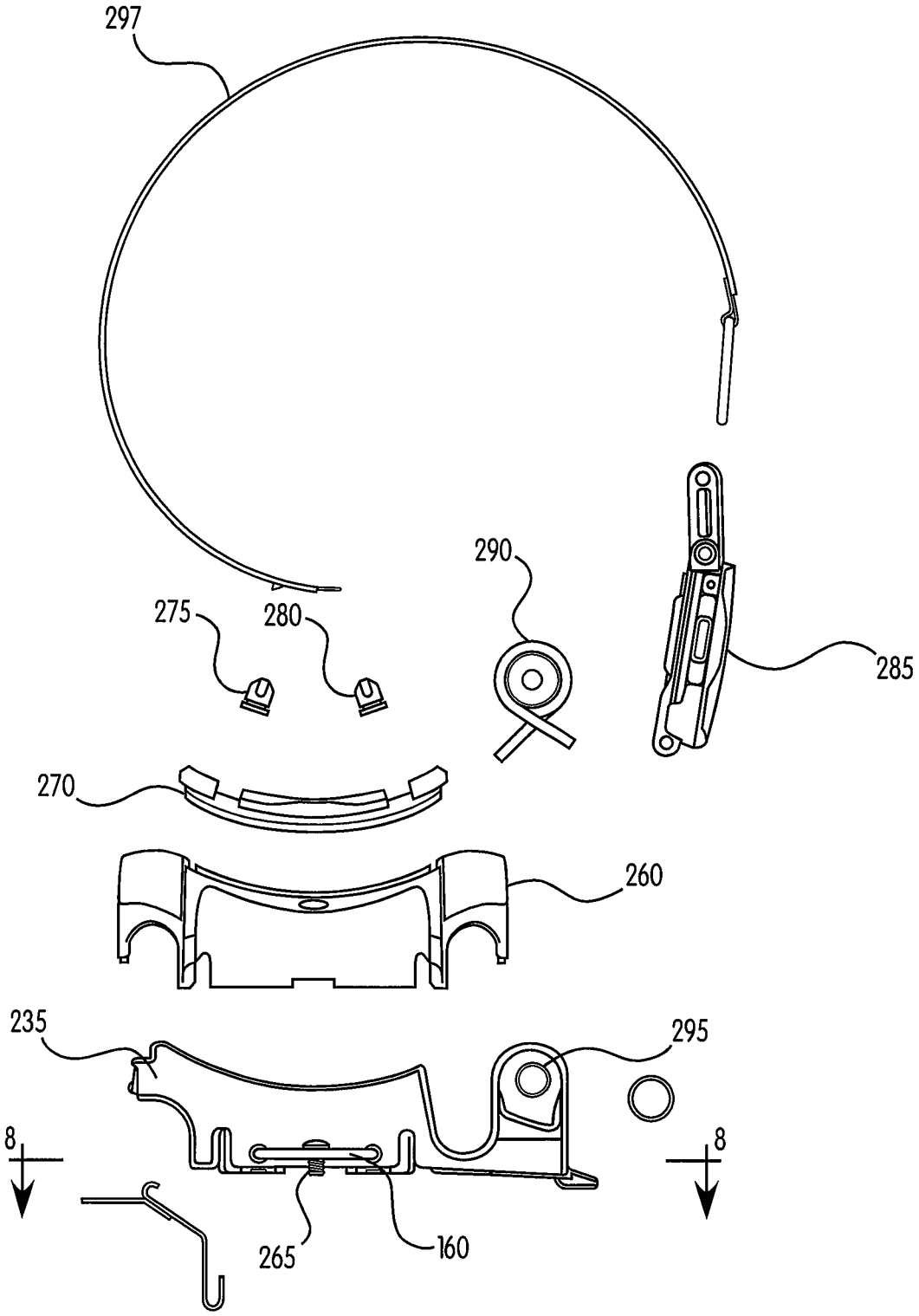
FIG. 9 is an exploded view of an assembly showing the manner by which a single cylinder may be attached to the cradle of FIG. 7.

The cross sectional projection illustrated in FIG. 8 is taken along lines 8-8 of FIG. 9 with respect to the tank cradle base 235 as it fits within a cavity 129 of the cradle receiving arrangement 125. For convenience, similar parts of cradle base 135 are used for the cradle base 235, but numbers are incremented by 100 to distinguish the two tank cradles. The cradle receiving arrangement 125 in FIG. 8 is identical to the cradle receiving arrangement 125 in FIG. 6, since the chassis 120 is the same whether the dual cylinder tanks cradle base 135 is used or the single cylinder tank cradle base 235 is used.

As can be seen from the footprint of the tank cradle 230 illustrated in FIG. 8, the features discussed for connecting the tank cradle 230 to the cradle receiving arrangement 125 are essentially identical, and for that reason will not be discussed at length with the understanding that the coupling features discussed with respect to the elements of FIG. 6 also apply to the elements of FIG. 8.

Just as before, the cradle receiving arrangement 125 includes walls 150', 153' with bores 152', 154'. Additionally, the tank cradle 235 includes projections 245', 248' with bores 247', 249' extending therethrough. When the bores 152', 154' are aligned with the bores 247', 249', an attaching member, e.g., the pin 160, may be inserted therein or engaged therewith to secure the tank cradle 235 to the cradle receiving arrangement 125 of the chassis 120.

What has been described is a single chassis having a standardized cradle receiving arrangement capable of accepting any of a number of variety of tank cradles so long as each of those tank cradles has a cradle base compatible with the cradle receiving arrangement 125. With reference to FIG. 6 and FIG. 8, it should be appreciated that each cradle base 135, 235 may have additional engagement with the cradle receiving arrangement 125, which may provide additional stability with the connection. In particular, in one preferred and non-limiting embodiment, and as illustrated in FIG. 6, the cradle receiving arrangement 125 includes a first peripheral cavity 170 having a wall 172 and a first peripheral projection 180 adjacent to and contacting the wall 172. Additionally, the cradle receiving arrangement 125 may have a second peripheral cavity 175 with a wall 177 and a second peripheral projection 185 adjacent to and contact the wall 177. By doing so, additional lateral support is provided to the tank cradle 130 when it is mounted to the chassis body 122. Similar features are also found in the arrangement of FIG. 8 and are labeled accordingly.

In a preferred and non-limiting embodiment, and as illustrated in FIG. 9, provided is hardware utilized in conjunction with the cradle base 235 to mount a single cylinder. In particular, as previously mentioned, the cradle base 235 is compatible with the chassis body 122 and secured therein utilizing the pin 160. In FIG. 9, a cradle cover 260 is mounted over the cradle base 235 and held thereto with a bolt 265 already shown secured at a lower position. A saddle portion 270 is secured to the cradle cover 260 and mounted to the saddle portion 270 are two contact members 275, 280. A latch assembly 285 is secured to the cradle base 235 through an intermediate spring 290 secured to a lug 295 protruding from the cradle base 235. An elongate band 295 is attached to the latch assembly 285 such that, with an air cylinder (not shown) placed against the saddle portion 270, the latch assembly 285 may be activated to secure the adjustment band 297 tightly around the air cylinder. As discussed above, the cradle cover 260 and/or the tank cradle 130 (or tank retainer arrangement) can be configured or shaped to receive and/or engage with any number of tanks. Further, the elongate band 295 may be in the form of a single metal band, a single fabric band, a twin metal band, a twin fabric band, a triple metal band, a triple fabric band, and the like.

In this manner, the present invention provides at least two tank cradles (one adapted for holding a single air cylinder and the other adapted for holding at least two air cylinders) that are individually secured to a common receiving arrangement in a chassis in a backpack of an SCBA, thereby alleviating the need for a customized design for each a single air cylinder and a dual air cylinder backpack. It should be appreciated that with the standardized mating arrangement between a tank cradle and the chassis 120 any number of different configurations may be attached to the chassis 120.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. An SCBA backpack for holding air cylinders, comprising:

a) a chassis with a cradle receiving arrangement, wherein the cradle receiving arrangement has a longitudinal axis, a base, a pair of upper walls protruding from the base, and a pair of lower walls protruding from the base and offset from the pair of upper walls, each of the upper walls and the lower walls having a bore extending therethrough, wherein the base, the pair of upper walls, and the pair of lower walls define at least one cavity such that the at least one cavity extends between the pair of upper walls and the pair of lower walls; and b) a tank cradle for holding at least one air cylinder, wherein the tank cradle has an attaching arrangement configured to directly or indirectly interact with the cradle receiving arrangement of the chassis to thereby removably secure the tank cradle to the chassis via a single attaching member that extends through the bores of the pair of upper walls, the bores of the pair of lower walls and across the at least one cavity of the cradle receiving arrangement and through a bore of the attaching arrangement, wherein the attaching arrangement of the tank cradle is received within the at least one cavity defined by the cradle receiving arrangement.

2. The backpack according to claim 1, wherein the attaching arrangement of the cradle comprises at least one projection.

3. The backpack according to claim 1, wherein a base of the tank cradle abuts with the chassis and is non-rotatably restrained thereto.

4. The backpack according to claim 1, wherein the attaching arrangement of the cradle has at least one projection, and wherein the at least one projection is shaped to fit substantially adjacent to at least one wall of the cradle receiving arrangement to locate and non-rotatably secure the cradle to the chassis.

5. The backpack according to claim 4, wherein both the at least one wall and the at least one projection have at least one common bore extending therethrough.

6. The backpack according to claim 1, wherein the attaching arrangement has at least one projection, wherein at least one of the at least one projection and the at least one cavity has at least one curved surface to accommodate mating.

7. The backpack according to claim 1, wherein a plane extends along the chassis and at least one wall and at least one projection extends substantially perpendicular to the plane when the tank cradle is secured to the chassis.

8. The backpack according to claim 7, further comprising a plurality of projections.

9. The backpack according to claim 8, further comprising at least one common bore configured to at least partially receive or interact with the attaching member.

* * * * *